US009494005B2

(12) United States Patent
Stowe

(10) Patent No.: US 9,494,005 B2
(45) Date of Patent: Nov. 15, 2016

(54) SUBTERRANEAN SOLIDS SEPARATOR

(71) Applicant: Baker Hughes Incorporated, Houston, TX (US)

(72) Inventor: Calvin J. Stowe, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 341 days.

(21) Appl. No.: 14/035,542

(22) Filed: Sep. 24, 2013

(65) Prior Publication Data

US 2015/0083392 A1 Mar. 26, 2015

(51) Int. Cl.
*E21B 27/00* (2006.01)
*E21B 31/00* (2006.01)

(52) U.S. Cl.
CPC ..... *E21B 27/00* (2013.01); *E21B 31/00* (2013.01)

(58) Field of Classification Search
CPC ..... E21B 27/00; E21B 27/12; E21B 21/00; E21B 27/005
USPC ..... 166/99
See application file for complete search history.

(56) References Cited

U.S. PATENT DOCUMENTS

| | | | | |
|---|---|---|---|---|
| 5,402,850 | A * | 4/1995 | Lalande | E21B 27/00 166/301 |
| 6,276,452 | B1 | 8/2001 | Davis et al. | |
| 7,472,745 | B2 | 1/2009 | Lynde et al. | |
| 7,478,687 | B2 | 1/2009 | Lynde et al. | |
| 2012/0061073 | A1 | 3/2012 | Soni et al. | |
| 2012/0325468 | A1 | 12/2012 | Rees et al. | |

* cited by examiner

*Primary Examiner* — David Andrews
*Assistant Examiner* — Manuel C Portocarrero
(74) *Attorney, Agent, or Firm* — Steve Rosenblatt

(57) ABSTRACT

A debris removal device for subterranean use features a debris laden inlet tube within a housing to define a debris collection space at the lower end of the housing. An eductor draws the debris laden fluid to the top of the inlet tube where the flow stream is returned to a downhole direction with discrete passages formed between the housing and the inlet tube by spaced parallel plates. The plates feature extending tabs on diametrically opposed lower ends of the plates. As a result flow heading back downhole can release debris and turn back uphole in passages defined between the outside of the plates and the inside wall of the housing. The tabs allow the flow turning uphole to make a greater radius turn because of a crossing over effect created by the tabs. There is less turbulence and narrower width to the flowing stream going uphole.

20 Claims, 6 Drawing Sheets

SUBTERRANEAN SOLIDS SEPARATOR

FIELD OF THE INVENTION

The field of the invention is solids removal devices for subterranean use and more particularly those that redirect the fluid stream twice while inducing flow patterns that enhance solids removal efficiency to the point where an internal screen becomes an optional feature in a solids separation device.

BACKGROUND OF THE INVENTION

Subterranean debris removal devices have been available in many forms. Different designs are targets at different sized debris. In the area of removal of sand and other particulates an eductor design offered by Baker Hughes Inc. under the name VACS features an eductor to draw debris laden fluid into an inlet tube that is surrounded by a housing to define the debris collection chamber. The debris laden flow makes side exits under an inverted cone cover where the idea is that the fluid stream is redirected back downhole followed by a turn to go back uphole so that the solids will be directed down into the annular collection volume and the remaining fluid stream will get drawn up by the eductor through a screen. This design is illustrated in U.S. Pat. No. 7,472,745 FIG. 1 showing the flow stream 32 making a turn to go through a screen 34 while the debris is supposed to drop into the annular volume 38. While this design does an admirable job with the larger particles it has been known on occasion to pass the finer particles with a result of flow interruptions as the screen clogs. Designs have been proposed to clear the screen by reversing flow direction through it or by providing signaling capabilities to indicate the flow through the device in real time. The basic design of the fluid stream through the device has remained unchanged for the most part until a recent development described below.

Referring to FIG. 1 a housing 10 has a debris inlet tube 12 that defines an annularly shaped debris collection volume 14. Debris laden flow exits the top 16 of the inlet tube 12 and hits the curved wall 18 for a reversal in the flow direction. The flow makes a 180 degree turn and goes in the downhole direction between parallel plates 20 and 22 that are in contact with the inlet tube 12 to define parallel passages 24 and 26 that extend to lower ends 28 and 30 of plates 20 and 22 respectively. Plates 20 and 22 define gaps between themselves and the inside wall of the housing 10 that represent another 180 degree turn for the debris laden fluid with the idea that the debris will separate into annular space 14 as the fluid drawn by an eductor as is used in the VACS system described above passes through a screen that is not shown and into the eductor inlet. The passages 24 and 26 are discrete along the outside of the inlet tube 12 until the lower ends 28 and 30 of the plates 20 and 22 are reached. At that point the fluid flow turns 180 degrees from passages 26 and 28 and commingles for the passage up the outer passages that are formed between the plates 20 and 22 and the inside wall of the housing 10.

While this design was an improvement over the separation capability of the design shown as FIG. 1 of U.S. Pat. No. 7,472,745 there were several issues with this design that limited its debris separation capability. The sharp radius bends that were required to transition from downhole direction of flow in passages 24 and 26 to the exit passage between the plates and the inside wall of the housing 10 caused wide flow streams to be formed that would not easily release the lighter weight solids that would have to cross the width of the flowing stream as that stream made an abrupt 180 degree short radius turn. Further the returning stream going uphole after making the second 180 degree turn would run up against the downhole oriented debris laden stream coming down passages 24 and 26 with the resulting turbulence of such opposed flows carrying off incoming debris from the passages 26 and 28 and carry such debris up to the screen and potentially clog the screen.

What was needed was to provide a better separator of solids from liquids in a confined space where the improved separation could rise to the level of omitting the screen shown in U.S. Pat. No. 7,472,745 FIG. 1. This has been accomplished with the present invention that has taken the FIG. 1 design and made improvements to add a pair of extending tabs from diagonally opposed corners at the lower ends of the parallel plates. The downhole flow can now cross over to go up without encountering the downhole oriented flow still coming down. The ability to cross over also makes for a larger radius of the flow stream and for a thinner stream to better allow solids to pass though the narrower width to be collected in the annular receptacle at the housing bottom. The same happens in mirror image on the other side due to the extending straight tabs. Alternatively one or a pair of diagonally opposed tabs with curvature can be used to operate on similar principles. These and other features of the present invention will be more readily apparent to those skilled in the art from a review of the description of the preferred embodiments and the associated drawings while understanding that the full scope of the invention is to be found in the appended claims.

SUMMARY OF THE INVENTION

A debris removal device for subterranean use features a debris laden inlet tube within a housing to define a debris collection space at the lower end of the housing. An eductor draws the debris laden fluid to the top of the inlet tube where the flow stream is returned to a downhole direction with discrete passages formed between the housing and the inlet tube by spaced parallel plates. The plates feature extending tabs on diametrically opposed lower ends of the plates. As a result flow heading back downhole can release debris and turn back uphole in passages defined between the outside of the plates and the inside wall of the housing. The tabs allow the flow turning uphole to make a greater radius turn because of a crossing over effect created by the tabs. There is less turbulence and narrower width to the flowing stream going uphole to allow better discharge of the solids as the last turn is made. Rounded tabs are envisioned. The collection efficiency can improve to the point where a screen for the educted flow going to the eductor inlet can be optionally removed.

DETAILED DESCRIPTION OF THE PREFERRED EMBODIMENT

Figure 5:
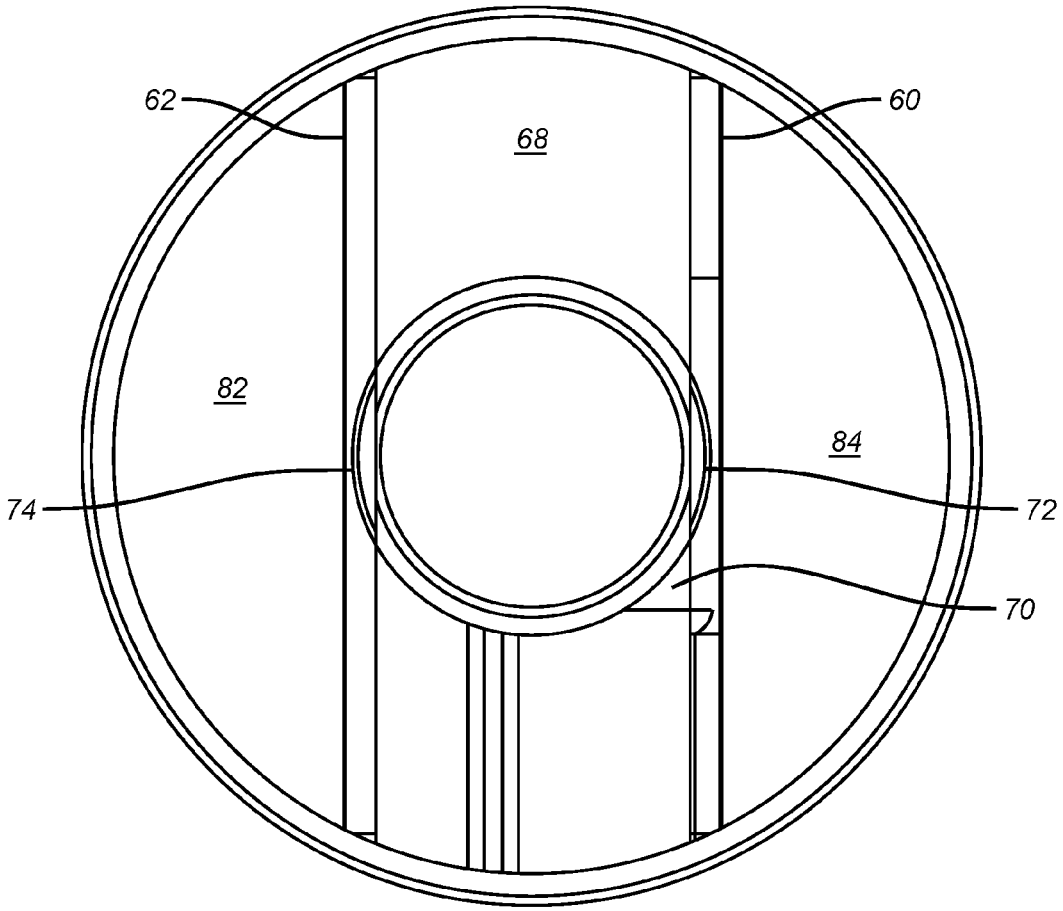
FIG. 5 is a top view of FIG. 3.
Figure 6:
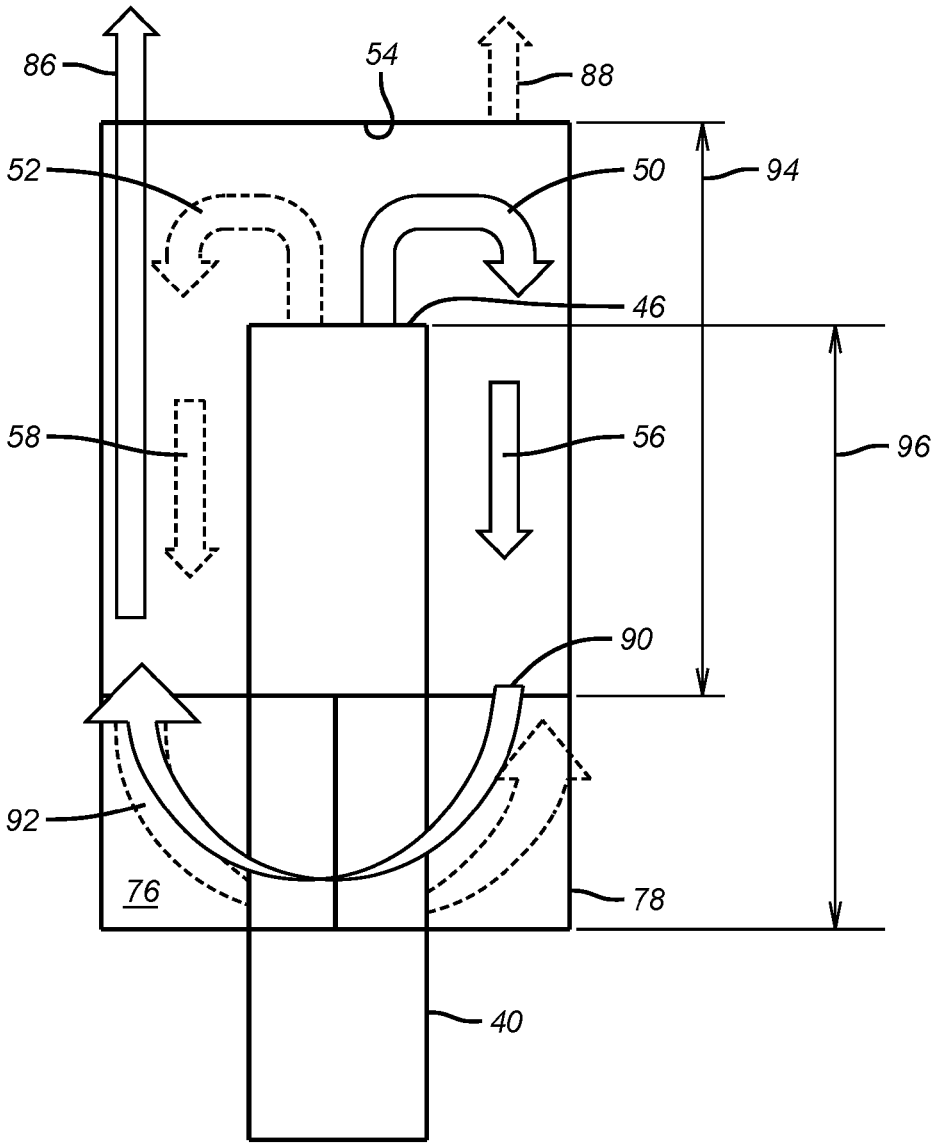
FIG. 6 is a schematic representation of the flow regime in the FIG. 2 embodiment showing the preferred dimensional relationships.

The basic debris removal tool design is illustrated in U.S. Pat. No. 7,472,745 FIG. 1 and the basic operation of the device covered there is incorporated by reference as if fully set forth here. Debris laden flow is induced with an eductor (not shown) into inlet tube 40 that is preferably centrally positioned in housing 42 to define an annular debris collection volume 44 that has a closed bottom (not shown) to retain the debris. The debris laden fluid makes a 180 degree turn after exiting through the open top 46 of tube 40 and impacting member 48 that is preferably a cylinder shape cut along the long axis and transversely mounted to the axis 48 of inlet tube 40. The flow regime for FIG. 2 is schematically illustrated in FIG. 6 showing arrows 50 and 52 as a split of the uphole debris laden flow in tube 40 as the top 46 is reached and there is impact with the curved surface 54 of member 48. Arrows 56 and 58 represent the tow discrete downhole directed flow paths defined by parallel plates 60 and 62 that extend in a downhole direction from spaced lower ends 64 and 66 of member 48. Plates 60 and 62 contact tube 40 tangentially to define discrete flow paths 68 and 70 as better seen in FIG. 5 that also shows the curved tab embodiment. The tangential contact locations are at 72 and 74. Extending tabs 76 and 78 extend in the same plane as plates 60 and 62 beyond what would otherwise the lower end 80. Rounding out the flow regime are outer passages 82 and 84 best shown in FIG. 5. Arrows 86 and 88 represent uphole oriented flow following the last 180 degree turn of the flowing fluid stream as further illustrated by arrows 90 and 92.

Figure 1:
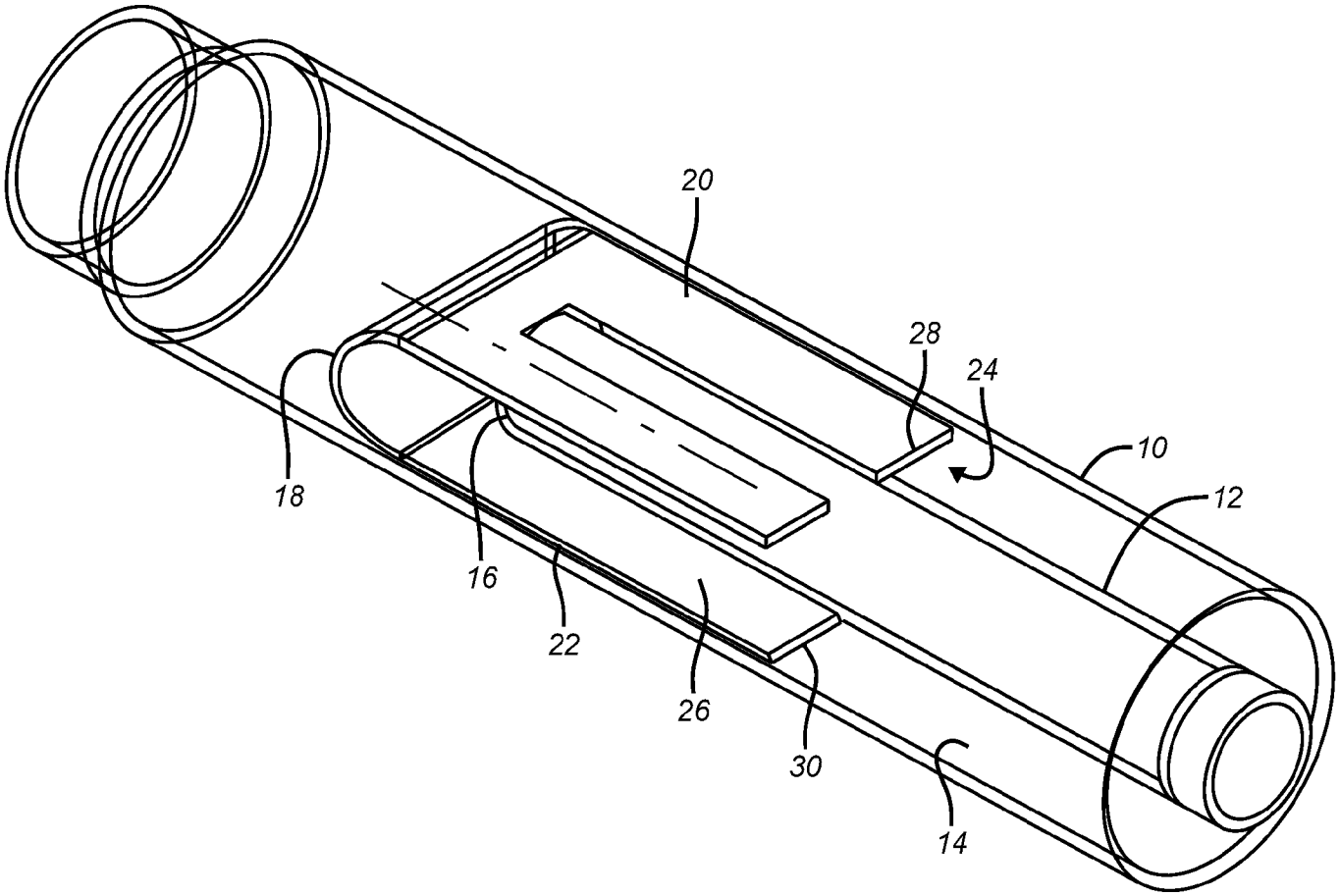
FIG. 1 a perspective view of a known design for separation of solids from a fluid stream.
Figure 2:
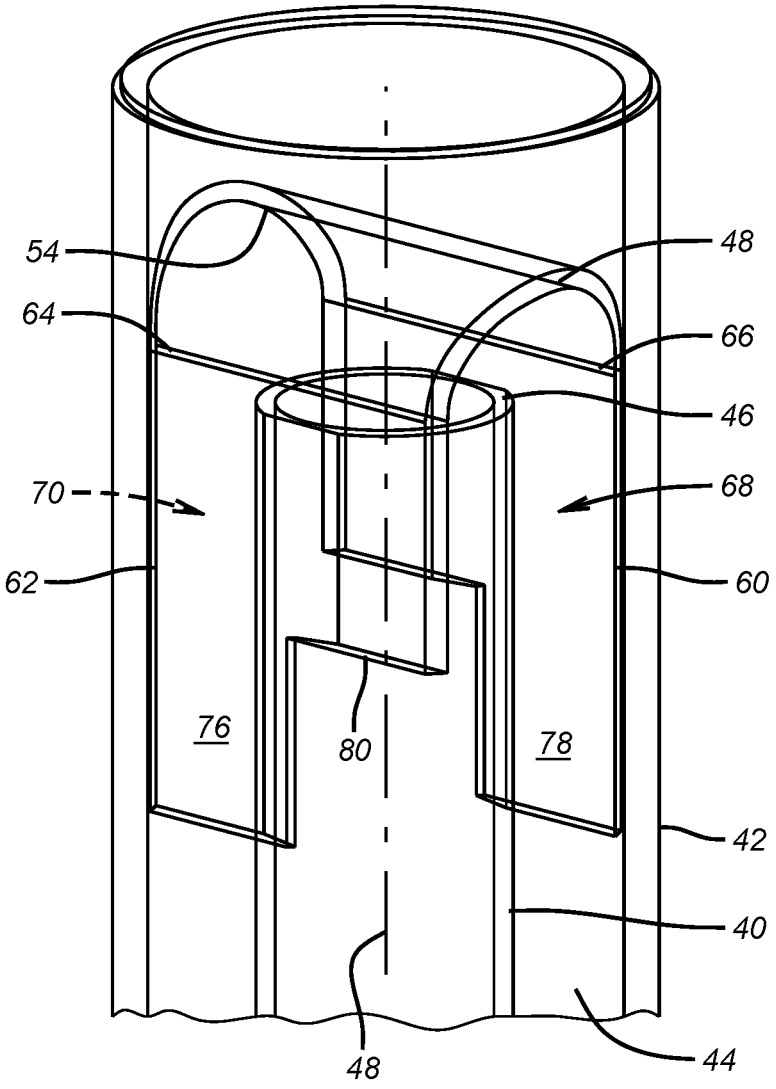
FIG. 2 is a perspective view of the present invention with lower end tabs in opposed corners to enhance separation efficiency.

It can now be appreciated why the debris separation capabilities of this design are dramatically enhanced from the design of FIG. 1. For example the flow represented by arrow 90 comes down passage 68 and crosses in front of tab 76 to get uphole through passage 82 as represented by arrow 86. Several things are noticeable about this flow regime. The radius of the 180 turn is longer as the flow takes the preferred path of least resistance. Moreover, the tab 76 shields the flow making the turn in front of it from flow behind the tab 76 represented by arrow 58. At the same time the flow represented by arrow 58 crosses over to go up behind tab 78 as graphically illustrated by arrow 92. What this means is each of the flows making the last 180 degree turn do so while shielded from the flows still heading downhole in the parallel passage. Flow in passage 70 represented by arrow 58 comes down and crosses over on the other side of tab 78 from where flow coming down passage 68 is crossing over on the opposite side of tab 76 from the down flow in passage 70.

The advantage of these flow regimes is better solids separation in a confined space. The ability to make a larger radius bend to turn 180 degrees to flow uphole allows for a narrower fluid stream. Thus smaller particles on the wrong edge of the narrower fluid stream have a shorter distance to travel to cross the fluid stream to be able to drop out of it as the 180 degree turn is made. The result is that more fines and finer particles of sand or other debris can be removed and the size of the removed particles can reach down to about 0.050" which is about half the dimension that the FIG. 1 design can remove. In some applications this degree of debris removal can allow for elimination of the internal screen that is shown in the debris removal device of FIG. 1 before the fluid stream enters the eductor inlet.

The shielding of fluid streams making a 180 degree turn to go uphole from flow coming downhole reduces turbulence and debris entrainment of the particles coming downhole by the flow making the turn to go uphole. The reduced turbulence also allows the formation of the narrower fluid stream that eases the ability of the particles to get flung across by centripetal force so that they can settle out of the fluid stream and get collected in the annular space 44. There is also a reduced swirling motion in the annular space 44 that in the FIG. 1 design could re-entrain particles already moving toward the bottom of space 44 so that they can undesirably be carried out of that space with the exiting clean fluid.

Figure 3:
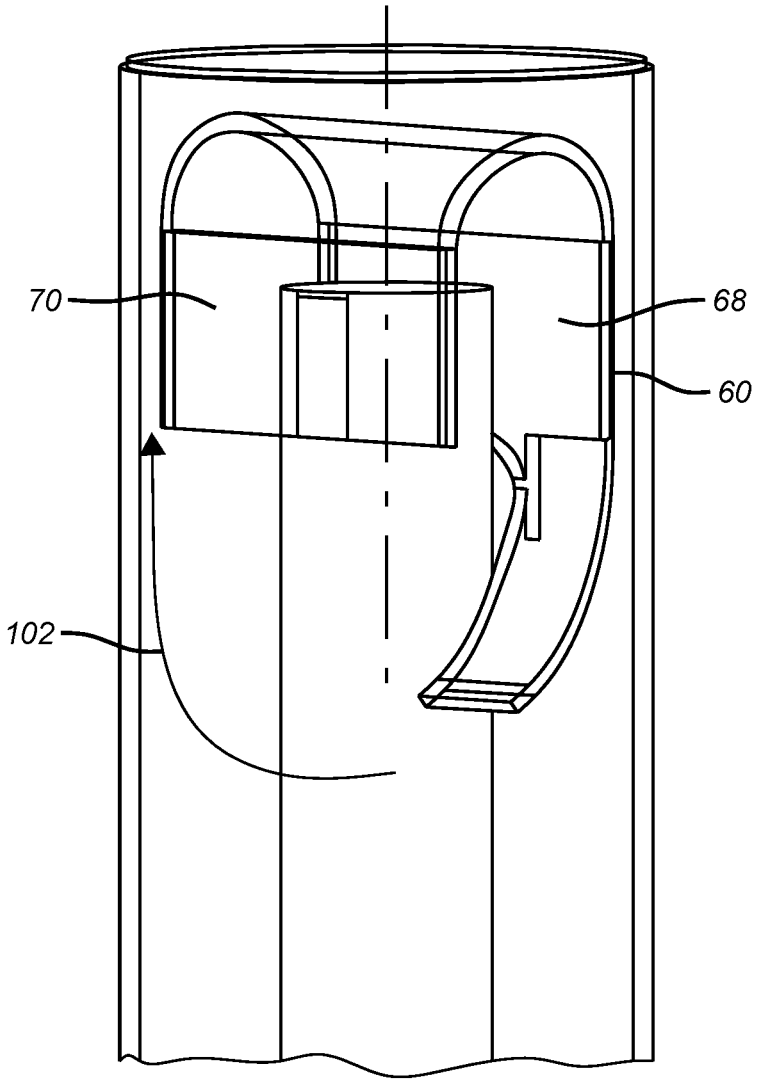
FIG. 3 shows an alternative embodiment with curved tab or tabs.
Figure 4:
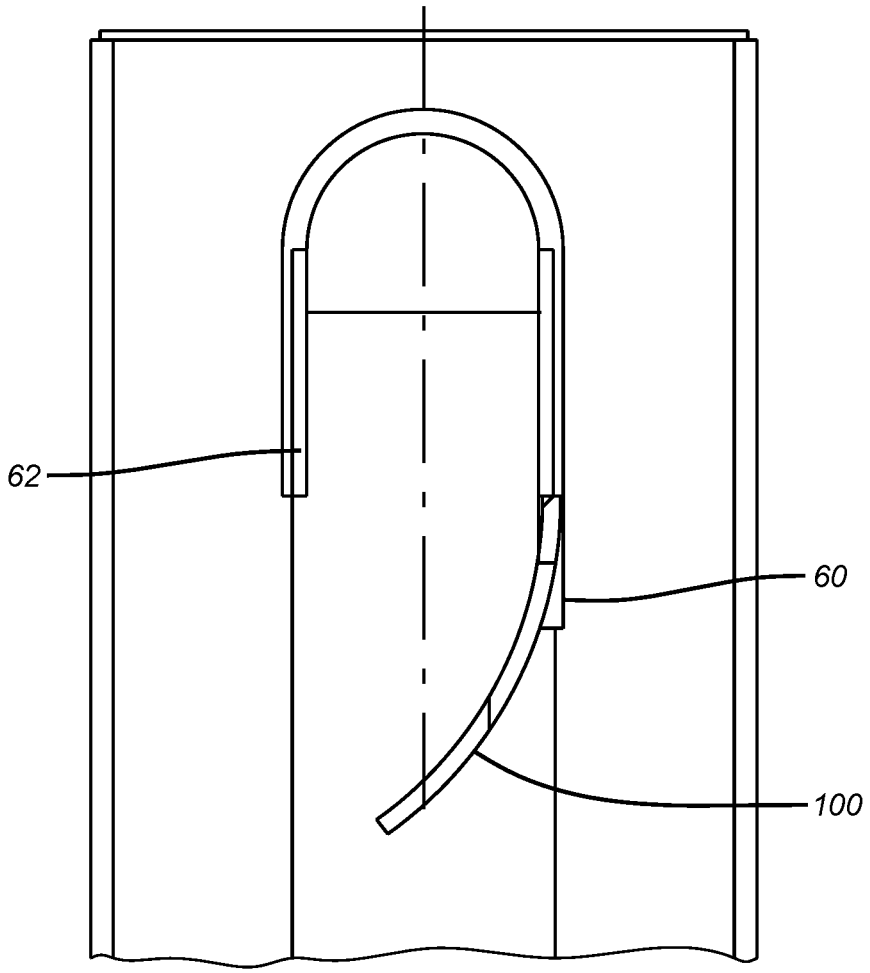
FIG. 4 is a side view of FIG. 3.

FIGS. 3 and 4 illustrate a similar tab concept to FIG. 2 except the one tab 100 that is illustrated is curved to get the desired crossing over effect illustrated by arrow 102. The downhole flow in passage 70 makes the last 180 turn sooner than the flow coming down passage 68 and preferentially moves in the opposite direction as the guidance provided by the curved tab 100 with some aid from the fluid stream coming off tab 100 and hitting the curved pipe wall which creates a mild spin action to further steer the fluid stream coming down passage 70 to the region behind plate 60 for the trip uphole. An alternative can be two curved tabs that are oppositely facing and arranged similarly to the straight tabs shown in FIG. 2. In that case the operating performance is similar to the FIG. 2 design described above and will not be repeated. On the other hand it has been determined from mathematical models that a single curved tab such as 100 may actually outperform the dual curved tab design. The same optimal dimensions described in FIG. 6 for the flat tab design are applicable to the curved tab version as well.

FIG. 6 also illustrates some optimal dimensional relationships for better solids removal efficiency. Arrow 96 illustrates the optimum height from the top 46 of tube 40 to the peak of curved surface 54 is one inside diameter of tube 40. Arrow 96 illustrates that the length of plates 60 and 62 including the lower end tab either 76 or 78 is four inside diameters of tube 40 while the optimum tab length is one inside diameter of tube 40.

Those skilled in the art will now appreciate that the efficiency of particulate removal in a confined space in a borehole is improved with the designs described above dramatically over the FIG. 1 design. These unexpected performance improvements allow removal down to smaller particle sizes and for the removal of significant quantities of solids to the extent that an internal screen is made an option. While opposed tabs for the flat tabs are preferred, some of the advantages may be recognized from a single tab. With the curved tabs the single tab design appears to function best based on mathematical modeling but diametrically opposed curved tabs can also show measurable improvement over the FIG. 1 design. While the principal use of the device is in induced circulation debris removal device that are powered with an eductor other circulation techniques can be used to collect not on sand or gravel but other debris such as pipe scale or mud residue or metallic or nonmetallic particles that are created with grinding or milling operations.

The above description is illustrative of the preferred embodiment and many modifications may be made by those skilled in the art without departing from the invention whose scope is to be determined from the literal and equivalent scope of the claims below:

I claim:

1. A debris removal apparatus for subterranean use, comprising:

a tubular housing having an uphole and a downhole end;

a debris laden flow inlet tube entering a closed lower end of said housing to define a debris collection volume between said inlet tube and an inner wall of said housing;

whereupon debris inlet fluid flow carrying debris that entered said inlet tube is redirected from initial movement out an open end of said inlet tube to flow in an opposite direction in parallel paths defined between said inlet tube and said inner wall of said housing and below said open end by an assembly of a deflector having extending walls of unequal lengths, said walls extend below said open end;

said debris inlet fluid flow after being deflected by said deflector turning toward said uphole end of said housing by passing outside said open end of said flow inlet tube a second time after clearing said extending walls while debris is separated toward said debris collection volume.

2. The apparatus of claim 1, wherein:

at least one of said extending walls has a longer portion defining a first tab disposed adjacent a first said path.

3. The apparatus of claim 2, wherein:

said extending walls define discrete flow paths for said debris inlet flow;

said first tab causing said debris inlet flow that flows toward said downhole end of said housing in said discrete path adjacent to where said first tab is located to be isolated from debris inlet flow from said other discrete path that turns toward said uphole end of said housing on an opposite side of said first tab.

4. The apparatus of claim 1, wherein:

said deflector comprises a curved surface facing said open end of said inlet tube.

5. A debris removal apparatus for subterranean use, comprising:

a tubular housing having an uphole and a downhole end;

a debris laden flow inlet tube entering a closed lower end of said housing to define a debris collection volume between said inlet tube and an inner wall of said housing;

whereupon debris inlet flow is redirected from initial movement out an open end of said inlet tube to flow in an opposite direction in parallel paths defined between said inlet tube and said inner wall of said housing by an assembly of a deflector having extending walls of unequal lengths;

said inlet flow turning toward said uphole end of said housing after clearing said extending walls while debris is separated toward said debris collection volume;

at least one of said extending walls has a longer portion defining a first tab disposed adjacent a first said path;

said first tab is in the same plane as said wall from which said first tab extends.

6. A debris removal apparatus for subterranean use, comprising:

a tubular housing having an uphole and a downhole end;

a debris laden flow inlet tube entering a closed lower end of said housing to define a debris collection volume between said inlet tube and an inner wall of said housing;

whereupon debris inlet flow is redirected from initial movement out an open end of said inlet tube to flow in an opposite direction in parallel paths defined between said inlet tube and said inner wall of said housing by an assembly of a deflector having extending walls of unequal lengths;

said inlet flow turning toward said uphole end of said housing after clearing said extending walls while debris is separated toward said debris collection volume;

at least one of said extending walls has a longer portion defining a first tab disposed adjacent a first said path;

said first tab extends out of the plane of said wall from which said first tab extends.

7. The apparatus of claim 6, wherein:

said first tab curves into the path of said parallel path defined by said wall from which said first tab extends.

8. A debris removal apparatus for subterranean use, comprising:

a tubular housing having an uphole and a downhole end;

a debris laden flow inlet tube entering a closed lower end of said housing to define a debris collection volume between said inlet tube and an inner wall of said housing;

whereupon debris inlet flow is redirected from initial movement out an open end of said inlet tube to flow in an opposite direction in parallel paths defined between said inlet tube and said inner wall of said housing by an assembly of a deflector having extending walls of unequal lengths;

said inlet flow turning toward said uphole end of said housing after clearing said extending walls while debris is separated toward said debris collection volume;

at least one of said extending walls has a longer portion defining a first tab disposed adjacent a first said path;

the other of said extending walls has a longer portion defining a second tab disposed adjacent a second said path.

9. The apparatus of claim 8, wherein:

said second tab is in the same plane as said wall from which said second tab extends.

10. The apparatus of claim 8, wherein:

said second tab extends out of the plane of said wall from which said second tab extends.

11. The apparatus of claim 10, wherein:

said second tab curves into the path of said parallel path defined by said wall from which said second tab extends.

12. The apparatus of claim 8, wherein:

said deflector comprises a curved surface facing said open end of said inlet tube.

13. The apparatus of claim 12, wherein:

said curved surface straddles said inlet tube with the distance between said open end of said inlet tube and the furthest location on said curved surface being at least one inside diameter of said inlet tube.

14. The apparatus of claim 13, wherein:

the axial length of said second tab is at least one inside diameter of said inlet tube.

15. The apparatus of claim 14, wherein:

said extending wall from which said second tab extends has an axial length of at least three inside diameters of said inlet tube.

16. The apparatus of claim 8, wherein:

said extending walls define discrete flow paths for said debris inlet flow;

said second tab causing said debris inlet flow that flows toward said downhole end of said housing in said discrete path adjacent to where said second tab is located to be isolated from debris inlet flow from said other discrete path that turns toward said uphole end of said housing on an opposite side of said second tab.

17. A debris removal apparatus for subterranean use, comprising:

a tubular housing having an uphole and a downhole end;

a debris laden flow inlet tube entering a closed lower end of said housing to define a debris collection volume between said inlet tube and an inner wall of said housing;

whereupon debris inlet flow is redirected from initial movement out an open end of said inlet tube to flow in an opposite direction in parallel paths defined between said inlet tube and said inner wall of said housing by an assembly of a deflector having extending walls of unequal lengths;

said inlet flow turning toward said uphole end of said housing after clearing said extending walls while debris is separated toward said debris collection volume;

said deflector comprises a curved surface facing said open end of said inlet tube;

said deflector comprises an axially split half cylinder having opposed ends from which said walls extend.

18. The apparatus of claim 17, wherein:

said half cylinder straddles said inlet tube with the distance between said open end of said inlet tube and the furthest location on said curved surface being at least one inside diameter of said inlet tube.

19. The apparatus of claim 18, wherein:

the axial length of said first tab is at least one inside diameter of said inlet tube.

20. The apparatus of claim 19, wherein:

said extending wall from which said first tab extends has an axial length of at least three inside diameters of said inlet tube.

* * * * *